United States Patent [19]

Suzuki et al.

[11] Patent Number: 4,718,152

[45] Date of Patent: Jan. 12, 1988

[54] METHOD FOR PRODUCING PATTERNED NON-WOVEN FABRIC

[75] Inventors: Migaku Suzuki; Toshio Kobayashi; Shigeo Imai, all of Kawanoe, Japan

[73] Assignee: Uni-Charm Corporation, Ehime, Japan

[21] Appl. No.: 728,943

[22] Filed: Apr. 30, 1985

Related U.S. Application Data

[63] Continuation of Ser. No. 455,493, Jan. 4, 1983, abandoned.

[30] Foreign Application Priority Data

Jan. 31, 1982 [JP] Japan ..... 57-13532

[51] Int. Cl.[4] ..... D04H 1/46

[52] U.S. Cl. ..... 28/104

[58] Field of Search ..... 28/104, 105

[56] References Cited

U.S. PATENT DOCUMENTS

| | | | |
|---|---|---|---|
| 3,113,349 | 12/1963 | Nottebohm et al. | 28/104 X |
| 3,281,902 | 11/1966 | Kalwaites | 19/106 R |
| 3,449,809 | 6/1969 | Shin | 28/105 X |
| 3,485,706 | 12/1969 | Evans | 28/105 X |
| 3,508,308 | 4/1970 | Bunting, Jr. et al. | 28/104 |
| 3,917,785 | 11/1975 | Kalwaites | 28/104 X |
| 4,172,172 | 10/1979 | Suzuki et al. | 28/104 X |
| 4,190,695 | 2/1980 | Niederhauser | 28/105 X |

FOREIGN PATENT DOCUMENTS

| | | | |
|---|---|---|---|
| 2488920 | 2/1982 | France | 28/104 |

*Primary Examiner*—Robert R. Mackey

*Attorney, Agent, or Firm*—Fred Philpitt

[57] ABSTRACT

A method for production of patterned nonwoven fabric from a fibrous web which is subjected to high energy treatment with high velocity water streams not only for fiber entangling but also for patterning of said fibrous web, wherein the fiber entangling treatment is performed on a plurality of non-porous supports arranged in multistaged manner at regular intervals along the path of the fibrous web and the patterning treatment is performed on a separate non-porous support arranged downstream of the previously mentioned non-porous supports and provided on a peripheral surface with a relief pattern.

6 Claims, 18 Drawing Figures

METHOD FOR PRODUCING PATTERNED NON-WOVEN FABRIC

This is a continuation of application Ser. No. 455,493, filed Jan. 4, 1983, now abandoned, and the benefits of 35 USC 120 are claimed relative to it.

BACKGROUND OF THE INVENTION

The present invention relates to a method for the production of patterned nonwoven fabric by sheet formation under hydraulic pressure treatment with high velocity water streams serving to cause fiber entanglement, and more particularly to such method for production of patterned nonwoven fabric comprising the steps of subjecting fibrous web to the hydraulic pressure treatment with high velocity fine water streams on water-impermeable supports to cause sufficient fiber entanglement in said fibrous web to form a sheet and then of subjecting this sheet to the similar treatment with high velocity fine water streams without deterioration of a strength of said sheet so that the entangled fibers may be reoriented by this last treatment to give the sheet a desired pattern.

It is well known to produce nonwoven fabrics by high energy treatment with water streams at unusually high pressure for fiber entanglement into a fibrous web. However, a mass production on a industrial scale has been difficult with this well known method, because only nonwoven fabric of unsatisfactory properties has been obtained with poor productivity and at a relatively high cost. In view of this situation, the inventors of the present invention have previously developed the effective method to improve the above-mentioned well known method and disclosed it in Japanese Patent Application No. 55-114151, U.S. patent application Ser. No. 293512 (now abandoned), GB Patent Application No. 8125263, West Germany Patent Application No. P31 32 792.3 and French Patent Application No. 81.16036. The invention thus disclosed in the applications in various countries was based on conditions that the supports for fibrous web should have a water-impermeability and a surface hardness of 50° or higher as defined by JIS (the Japanese Industrial Standards)-K 6301 Hs; that each of the orifices adapted to jet the water streams at high pressure should have a vertical section comprising a diameter downwardly tapered portion and a linear small diameter portion, L/D, a ratio of the length L and the diameter of the former portion, being less than 4/1; that each of the water streams should be supplied transversely with respect to each of said supports at a flow rate of 40 cc/sec.cm or lower; that the pressure at which the water streams are jetted through the associated orifices should be lower than 35 kg/cm$^2$; and that a basic weight of the fibrous web to be treated should be between 15 and 100 g/cm$^2$.

It is also well known to produce patterned nonwoven fabric by a similar high energy treatment with water streams at high pressure. Such method also has drawbacks similar to those encountered by the above mentioned method.

In view of this situation, the inventors have developed an improved and novel method for production of patterned nonwoven fabric comprising continuous steps of the sheet formation by the fiber entangling treatment according to the previous invention of the inventors and of patterning. More specifically, the present invention is characterized by that, in the previously proposed method in accordance with said previous invention, there is provided as the fibrous web support of the final stage a support provided on its surface with a relief pattern so that the nonwoven fabric may be thereby correspondingly patterned.

The method according to the present invention thus enables patterned nonwoven fabrics of excellent properties to be produced at higher productivity and lower cost compared to the method of the prior art. The nonwoven fabrics obtained by the method of this invention have the bulkiness improved by the relief patterns and the surface gloss so matted that they look as if they are cotton fabrics. Thus, the cushiony, soft and warm touch of the product is remarkably improved. The relief pattern presents high density areas and low density areas so that the spot absorption capacity for liquid is also improved. The patterned nonwoven fabrics according to the present invention will find advantageous applications in a series of goods which are used in direct contact with the skin of the human body, for example, the surface material of a sanitary napkin or a disposable diaper.

SUMMARY OF THE INVENTION

According to the present invention, there is provided a method for the production of patterned nonwoven fabric substantially comprising the steps of subjecting a fibrous web which has a basic weight of 15 to 100 g/m$^2$ to a fiber entangling treatment, on a plurality of supports each consisting of a water-impermeable roll having a substantially smooth surface and arranged at intervals along a path of the fibrous web, by fine water streams supplied at high velocity from orifices of nozzle means arranged so as to cooperate with the associated supports or rolls; and subjecting the fibrous web having its fibers entangled by the foregoing step, on a support consisting of a roll or endless belt having a relief pattern on its surface and arranged downstream of the last support for the previous step, to similar treatment by fine water streams supplied at high velocity from orifices of nozzle means arranged so as to cooperate with the last-mentioned support so that the fibers in said fibrous web may be effectively reoriented by this treatment to give the sheet the corresponding relief pattern.

BRIEF DESCRIPTION OF THE DRAWING

Preferred embodiments of the present invention will be described in reference with the accompanying drawing in which.

DESCRIPTION OF PREFERRED EMBODIMENTS

Figure 1:
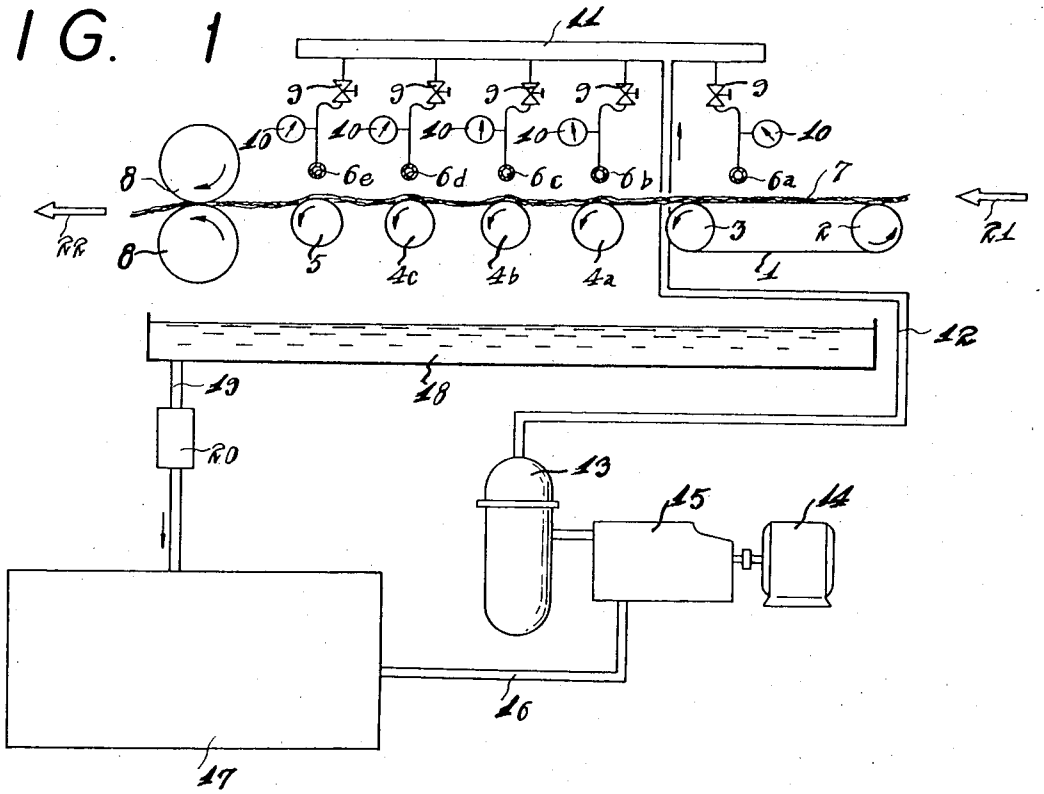
FIG. 1 is a schematic side view showing an apparatus used for realization of a method according to the present invention.
Figure 3:
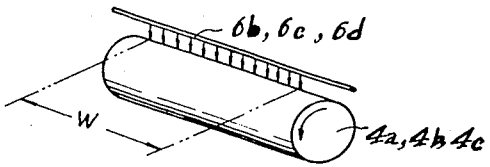
FIG. 3 is a perspective view showing a water-impermeable roll serving as the second support for a fibrous web.
Figure 4:
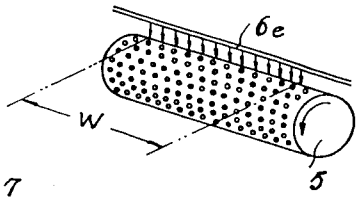
FIG. 4 is a perspective view showing a water-impermeable roll serving as the third support for a fibrous web.
Figure 2:
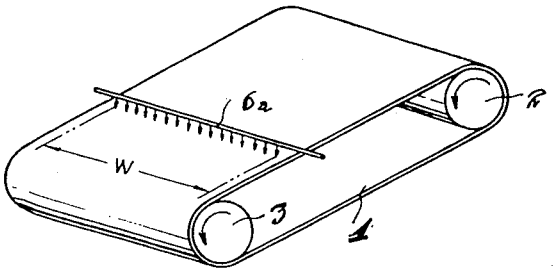
FIG. 2 is a perspective view showing a water-impermeable belt serving as the first support for a fibrous web.

In FIG. 1, a water-impermeable and substantially smooth-surfaced endless belt 1 as the first support is suspended between a pair of rolls 2, 3, and at the left hand thereof as seen in FIG. 1, there are provided three water-impermeable and substantially smooth-surfaced rolls 4a, 4b and 4c as the second supports. At the left hand thereof, there is provided a water-impermeable roll 5 carrying on its surface a relief pattern as the third support. There are provided nozzle means 6a, 6b, 6c, 6d, 6e above the belt 1, the rolls 4a, 4b, 4c and the roll 5, respectively (see FIGS. 2, 3 and 4). At the left hand of the roll 5 as seen in FIG. 1, a pair of squeeze rolls 8 is provided to remove any excess water from the fibrous web 7. The respective nozzle means 6a, 6b, 6c, 6d, 6e are connected via associated pressure regulating valves 9 and pressure gauges 10 to a distributing reservoir 11. The distributing reservoir 11 is connected via a pipe 12 to a filter reservoir 13 which is, in turn, connected to a pressure pump 15 driven by a motor 14. The pump 15 is connected via a pipe 16 to a reservoir 17. Under the belt 1, the rolls 4a, 4b, 4c, the roll 5 and the rolls 8, there is arranged a tray-like recovery reservoir 18 which is connected via a pipe 19 and a filter box 20 reservoir 17. A quantity of water within the reservoir 17 is pressurized by the pressure pump 15 to an adequately high level, filtered by the filter reservoir 13, then supplied to the distributing reservoir 11, distributed by said reservoir 11 to the respective nozzle means 6a, 6b, 6c, 6d, 6e, and finally jetted through the respective orifices formed in the bottoms of the respective nozzle means at desired pitches unto the belt 1, the rolls 4a, 4b, 4c, and the roll 5, respectively, in the form of high velocity fine water streams (see FIGS. 2, 3 and 4).

In the apparatus as has been described just above, a fibrous web 7 introduced in the direction as shown by an arrow 21 onto the belt 1 and transported in the direction shown by arrow 22 is subjected first to a preliminary fiber entangling treatment on the belt 1 with high velocity water streams supplied through the orifices of the nozzle means 6a so that the fibrous web 7 may be bestowed with an appropriate interlacing cohesiveness of fibers as said fibrous web is transported along the path defined by the belt 1 and the rolls 4a, 4b, 4c without any conspicuous deformation or damage of the web due to a high pressure of the high velocity water streams jetted from the orifices of the respective nozzle means 6b, 6c, 6d. The fibrous web having the fibrous interlacing cohesiveness reinforced in this manner to some degree is then subjected to the fiber entangling treatment in stages and in a full scale under action of the high velocity water streams jetted from the orifices of the respective nozzle means 6b, 6c, 6d as said fibrous web 7 is transported over the respective rolls 4a, 4b, 4c. During this step, the substantially complete sheet in the form of nonwoven fabric having a desired strength is obtained. This nonwoven fabric or the fibrous web 7 having fibers entangled to a desired degree is then treated, on the roll 5, with the high velocity water streams jetted from the orifices of the associated nozzle means 6e and has its fibers reoriented thereby so that a pattern corresponding to the relief pattern carried on the surface of said roll 5 is imparted to the nonwoven fabric. Then, substantially the whole quantity of water contained in the nonwoven fabric is removed by the squeeze rolls 8 and thereafter the nonwoven fabric is transferred to a subsequent process of drying.

Figure 5:
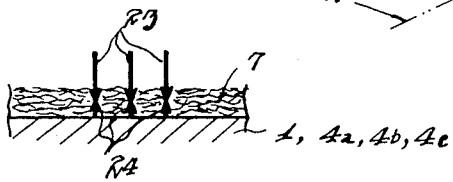
FIG. 5 is a diagram illustrating a principle on which the high velocity fine water streams act upon a fibrous web.
Figure 6:
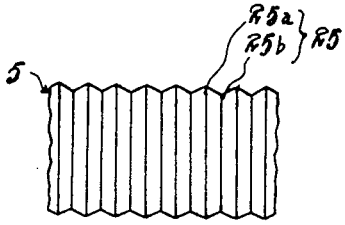
FIGS. 6 to 9 are plan views showing by way of example various relief patterns which may be carried by the surface of the third roll.
Figure 7:
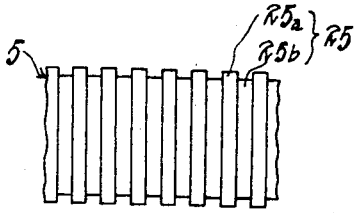
Figure 8:
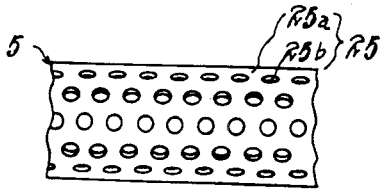
Figure 9:
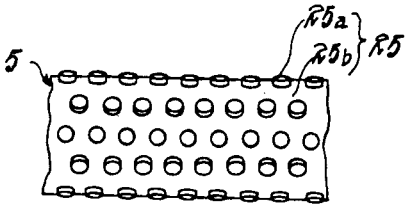

FIG. 5 illustrates the principle on which the high velocity water streams behave when the fibrous web is subjected to the fiber entangling treatment on the belt 1 and the rolls 4a, 4b, 4c. The water streams 23 penetrate the thickness of the fibrous web 7, then strike the belt 1 and the rolls 4a, 4b, 4c and rebound thereon upwards so as to act upon the fibrous web 7. Thus, the fibrous web 7 is really subjected to a fiber entangling treatment by reciprocal effect of the water jet streams 23 and their rebounding streams 24, and, in consequence, individual fibers in the fibrous web 7 are displaced in three-dimensional directions so that the fibrous web attains complicated, cohesive and efficient fiber entanglement. The water streams of which the initial energy has been consumed for the fiber entangling treatment now drip off along the supports and partially along the side edges of the travelling fibrous web 7, and finally are recovered by the reservoir 18. Such behaviour of the water streams that these high velocity water streams rebound on the surfaces of the respective supports and the rebounding streams contribute again to the fiber entangling treatment is possible only on the assumption that the respective supports should have an adequately high surface hardness. According to the present invention, therefore, the belt 1 serving as the first support and the rolls 4a, 4b, 4c serving as the second support have their surface hardnesses of 50° or higher, preferably of 70° or higher in accordance with JIS (the Japanese Industrial Standards )-K 6301 Hs. So far as the respective supports have such surface hardnesses and sufficient strengths to resist the pressure of the high velocity water streams, said belt 1 and rolls 4a, 4b, 4c may be exclusively made of metal, rubber or plastic, or of multilayered construction comprising a combination of these materials. Diameters of said rolls 4a, 4b, 4c are preferably selected between 50 mm and 300 mm in order that sufficient strength to resist the pressure of said high velocity water streams may be obtained and the drainage may be facilitated.

FIGS. 6 to 9 show by way of example various relief patterns which can be carried on the roll 5 serving as the third support. Said fibrous web or the nonwoven fabric already fiber entangled to form a stabilized sheet is now subjected to the patterning treatment on the roll 5 and thereby given a pattern corresponding to the relief pattern 25 carried on said roll 5. Such patterning of the nonwoven fabric is achieved due to a fiber reorientation in that the fibers lying on the projection areas 25a of said relief pattern 25 are partially driven by the pressure of the high velocity water streams into the recess areas 25b. It is important, therefore, the orifices of said nozzle means 6e should be arranged so as to direct the water streams jetted from the respective orifices accurately to the projection areas 25a and, to enable it, the orifices each having a diameter of 0.05 to 0.2 mm should be arranged at a pitch less than 2 mm. When the recess areas 25b of the relief pattern 25 are shallower than 0.1 mm, on one hand, the fiber displacement under the pressure of the water streams would be insufficiently small to form a distinct pattern on the nonwoven fabric, and when the recess areas 25b are 1.0 mm or deeper, on the contrary, it would be difficult to peel the nonwoven fabric off from the roll 5 and the pattern once formed on the nonwoven fabric would be disturbed during this operation of peeling off, although such relatively deep recess areas 25b certainly permit a distinct pattern to be formed on the nonwoven fabric. It should be understood here that the high velocity water streams behave on the roll 5 in the same manner as described in connection with FIG. 5 and therefore the fiber entanglement occurs also on the roll 5, but the desired water entanglement has already been achieved before the roll 5. Namely, the step of the method according to the present invention which is accomplished on this roll 5 is exclusively for the patterning treatment of the nonwoven fabric.

Figure 15:
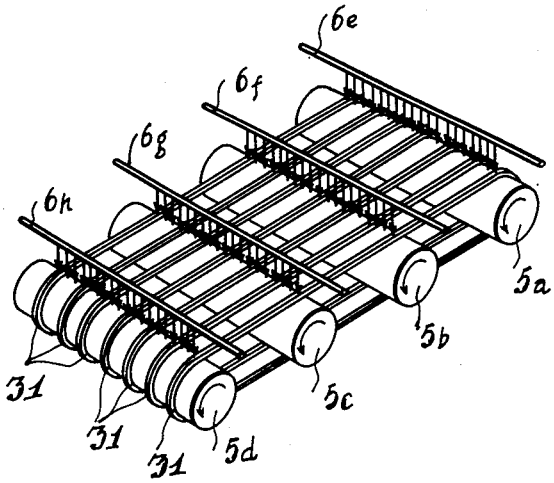
FIG. 15 is a perspective view showing another example of relief patterns which may be carried by a plurality of cord like endless belts suspended among each of a plurality of rolls as the third support for a fibrous web.

The relief pattern 25 may be directly engraved in the surface of the roll 5, or a separate member provided with the relief pattern engraved in the surface thereof may be mounted on the surface of the roll 5 (not shown). Furthermore, a plurality of cord-like members 31 may be stably suspended at intervals among the rolls 5a, 5b, 5c and 5d above which the nozzle means 6e, 6f, 6g, 6h, respectively, are disposed, as shown in the FIG. 15, or a separate mesh-like member may be mounted on the surface of the rolls 5a–5d (not shown). Just like said belt 1 and rolls 4a, 4b, 4c, the rolls 5, 5a, 5b, 5c, 5d also may be exclusively made of metal, rubber or plastic, or of multilayered construction comprising a combination of these materials. Diameter of this roll 5 also is preferably selected between 50 mm and 300 mm in order that the sufficiently high strength to resist the pressure of said high velocity water streams may be obtained and the drainage may be facilitated. It should be noticed here that the roll 5 may be replaced by an endless belt although the latter is not shown.

Figure 10:
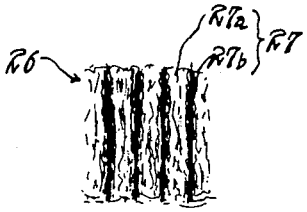
FIGS. 10 to 13 are plan views showing the nonwoven fabrics obtained by the patterning treatment on the supports as shown by FIGS. 6 to 9, respectively.
Figure 11:
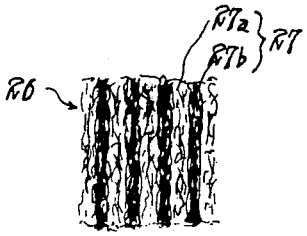
Figure 12:
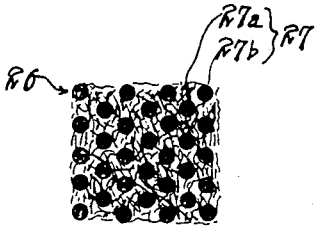
Figure 13:
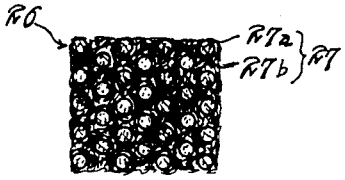
Figure 14A:
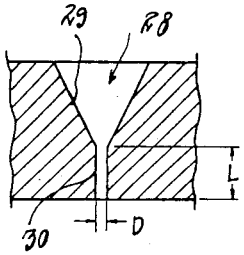
FIGS. 14(A) through 14(D) show by way of example various configurations of each orifice formed in the bottom of each nozzle means in vertical sections.
Figure 14B:
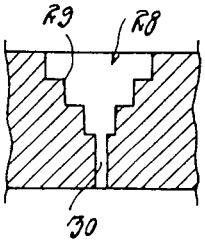
Figure 14C:
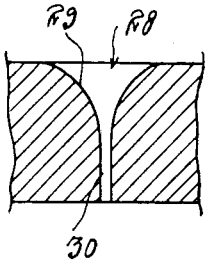
Figure 14D:
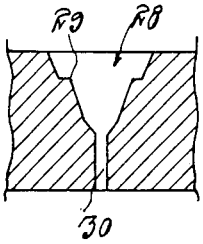

FIGS. 10 to 12 show the nonwoven fabrics 26 respectively subjected, on the relief patterns 25 carried by the respective rolls 5, to the patterning treatment and having obtained the patterns 27 corresponding to the particular patterns 25 of the associated rolls 5. The pattern 27 formed on each nonwoven fabric 26 has a low density in the area 27a corresponding to each projection area 25a and a high density in the area 27b corresponding to each recess area 25b of said relief pattern 25.

FIG. 14 shows by way of example various configurations of each orifice 28 formed in the bottom of each nozzle means 6a, 6b, 6c, 6d, 6e in vertical sections. The orifice 28 may have a diameter of 0.05 mm to 0.2 mm and, as shown by FIGS. 14(A), (B), (C) and (D) in vertical section, comprise a downward tapered portion 29 and a linear portion 30 at a ratio L/D less than 4/1, preferably less than 3/1 where L represents a length and D represents a diameter of said portion 30. Such configuration of the orifice 28 reduces a pressure loss due to the water stream resistance possibly occurring in said orifice 28. When the orifice 28 is cylindrically formed with an invariable diameter and said ratio L/D is 4/1 or higher, said pressure loss due to the water stream resistance will increase and result in a negligible inconvenience in economic aspects.

Flow rate of the high velocity water streams to be jetted from the nozzle means 6a, 6b, 6c, 6d, 6e provided with such orifices 28 onto the respective supports is less than 40 c.c./sec.cm and preferably less than 30 c.c./sec.cm. The term "transverse average flow rate" means a value F/W where F represents a total flow jetted onto each support, i.e., each of the belt 1, the rolls 4a, 4b, 4c, and the roll 5 as shown by FIGS. 1 to 4 and W represents an effective width of each nozzle means 6a, 6b, 6c, 6d, 6e. Said transverse average flow rate of 40 c.c./sec.cm or higher would result in that the high velocity water streams jetted onto the belt 1, the rolls 4a, 4b, 4c or the roll 5 can not be satisfactorily drained and, in consequence, the fibrous web is flooded. As a result, the energy of the high velocity water streams acting upon the web would be sharply reduced and the fiber entangling effect as well as the patterning effect would be deteriorated or disturbance appearing in the fibrous web would impair the stability of the treatment's result.

A jet pressure of the high velocity water streams or, more strictly, a back pressure in each nozzle means 6a, 6b, 6c, 6d, 6e is less than 35 kg/cm$^2$, and preferably 10 to 30 kg/cm$^2$. Said back pressure of 35 kg/cm$^2$ or higher would result in that the individual fibers in the fibrous web are displaced too far to maintain a desired stability of said fibrous web and thereby the fiber entanglement becomes uneven. A back pressure lower than 7 kg/cm$^2$ would make it impossible to produce the nonwoven fabric of excellent property at a high productivity, even when the fibrous web is subjected for an excessively long period to the treatment with the high velocity water streams or even when said nozzle means are arranged close to the surface of the fibrous web.

As material for the fibrous web, every kind of fibers conventionally used for woven or nonwoven fabrics may be used in the form of tandem web, parallel web or cross web. In view of the fact that the endless belt and/or the rolls having water impermeable surfaces are used as the supports for the fibrous web to be treated, as previously described, the fibrous web of which the basic weight is 15 to 100 g/m$^2$ and preferably 20 to 60 g/m$^2$ must be used in order that the energy of the high velocity water streams effectively act on the fibrous web. When the basic weight is less than 15 g/m$^2$, the fibrous web would become uneven and, in consequence, it would be impossible to obtain a practically uniform nonwoven fabric. When the basic weight is 100 g/m$^2$ or higher, use of the water impermeable supports would be in vain.

EXAMPLE

Fibrous web having a basic weight of 38 g/cm$^2$ and comprising 50% of polyester fibers (1.4 d×51 mm) by weight and 50% of rayon fibers (1.5 d×51 mm) by weight was treated and several samples of nonwoven fabric were produced. The inventors used the apparatus as shown by FIG. 1, in which the jet pressure was 30 kg/cm$^2$, the nozzle means each having the orifices arranged at a pitch of 0.5 mm were selected, and the rolls provided with the relief patterns directly engraved in their surfaces as well as the rolls provided with the relief patterns in the form of wire meshes mounted on their surfaces were used as the third support. The recess depths of the recess area in the relief pattern carried on each roll, and the basic weights, the strengths and the pattern qualities of the obtained nonwoven fabric samples are shown in the following table.

TABLE

| Sample No. | Support Surface | Support Recess depth (mm) | B.W. of nonwoven fabric ($g/cm^2$) | Tensile strength ($kg/cm^2$) | Pattern Quality |
|---|---|---|---|---|---|
| 1 | Engraved | 0.1 | 35.2 | 3.5 | Indistinct |
| 2 | " | 0.5 | 33.1 | 3.6 | Distinct |
| 3 | " | 2.0 | 35.2 | 3.3 | " |
| 4 | Wire mesh (100 mesh) | — | 37.5 | 3.4 | Indistinct |
| 5 | Wire mesh (30 mesh) | — | 34.2 | 3.3 | Distinct |

We claim:

1. A process for producing nonwoven fabrics wherein a fibrous web is guided onto a water-impermeable supporting member and said fibrous web is subjected to a plurality of fine water jet streams supplied at a jet pressure of 35 $Kg/cm^2$ or lower from a plurality of nozzles which are arranged at spaced apart intervals across the width of the fibrous web, whereby entangling treatment of the individual fibers of said fibrous web is carried out; the improvement which comprises (a) starting with a fibrous web weighing from 15 to 100 $g/m^2$, (b) guiding said fibrous web into a preliminary entangling stage that comprises a first supporting member consisting of a smooth-surfaced water-impermeable endless belt, (c) carrying out a preliminary entangling treatment in said preliminary entangling stage by ejecting a plurality of water jet streams from a plurality of nozzles arranged transversely with respect to the direction of movement of said first supporting member, (d) guiding said fibrous web from said preliminary entangling stage to a final entangling stage consisting of a plurality of spaced-apart smooth surfaced water-impermeable rolls, (e) carrying out a final entangling treatment with water jet streams ejected from a plurality of nozzles that are located above and in parallel alignment with said spaced apart smooth-surfaced water-impermeable rolls, (f) thereafter subjecting the fibrous web resulting from step (e) to a patterning treatment on a water-impermeable support having a relief pattern thereon comprising raised portions and recessed portions, said patterning treatment comprising directing a plurality of spaced apart high velocity water streams directly upon the fibrous web toward the raised portions of said relief pattern in an unobstructed manner as the fibrous web passes over said patterned support so that the fibers in the fibrous web resulting from step (e) are reoriented by the action of said plurality of spaced apart high velocity water streams and form a distinct pattern in the fibrous web corresponding to the relief pattern that is on the patterned support which the web moves over.

2. A method according to claim 1 wherein said recesses in step (f) are 0.1 to 1.0 mm deep.

3. A method according to claim 1 wherein said plurality of spaced apart high velocity water streams are formed by water passing through nozzle means that include orifices which are 0.05 to 0.2 mm in diameter and arranged at a pitch of 2 mm or less.

4. A method according to claim 1 wherein the fibrous web continues to move in a substantially horizontal plane from a point before step (b) until after the completion of step (f).

5. A method according to claim 4 wherein said recesses in step (f) are 0.1 to 1.0 mm deep.

6. A method according to claim 4 wherein said plurality of spaced apart high velocity water streams are formed by water passing through nozzle means that include orifices which are 0.05 to 0.2 mm in diameter and arranged at a pitch of 2 mm or less.

* * * * *